United States Patent [19]

Everett et al.

[11] Patent Number: 5,028,345

[45] Date of Patent: Jul. 2, 1991

[54] LUBRICATING OIL COMPOSITION

[75] Inventors: Armgard K. Everett, Warson Woods; Edmund F. Perozzi, Crestwood, both of Mo.

[73] Assignee: Ethyl Petroleum Additives, Inc., St. Louis, Mo.

[21] Appl. No.: 304,772

[22] Filed: Jan. 31, 1989

Related U.S. Application Data

[63] Continuation-in-part of Ser. No. 281,262, Dec. 7, 1988, Pat. No. 4,960,530, which is a continuation-in-part of Ser. No. 175,761, Mar. 31, 1988, abandoned.

[51] Int. Cl.[5] ..... C10M 135/06; C10M 105/72

[52] U.S. Cl. ..... 252/32.7 E; 252/33; 252/33.2; 252/46.6; 252/46.7; 252/47.5; 252/48.6

[58] Field of Search ..... 252/32.7 R, 33, 32,7 E, 252/46.6, 46.7, 47.5, 48.6

[56] References Cited

U.S. PATENT DOCUMENTS

| | | | |
|---|---|---|---|
| 2,680,718 | 6/1954 | Eby | 252/48.6 |
| 3,290,130 | 12/1966 | Assmann | 44/58 |
| 3,600,327 | 8/1971 | Hu | 252/32.7 |
| 3,899,432 | 8/1975 | Rothert et al. | 252/32.7 |
| 3,933,659 | 1/1976 | Lyle et al. | 252/32.7 |
| 3,954,639 | 5/1976 | Liston | 252/47.5 |
| 3,997,454 | 12/1976 | Adams | 252/18 |
| 4,046,702 | 9/1977 | Liston | 252/33.4 |
| 4,086,172 | 4/1978 | Lowe | 252/47.5 |
| 4,089,790 | 5/1978 | Adams | 252/18 |
| 4,161,451 | 7/1979 | Lowe | 252/47.5 X |
| 4,163,729 | 8/1979 | Adams | 252/18 |
| 4,170,560 | 10/1979 | Lowe | 252/47.5 X |
| 4,201,684 | 5/1980 | Malec | 252/47.5 |
| 4,208,293 | 6/1980 | Zaweski | 252/51.5 |
| 4,236,898 | 12/1980 | Davis et al. | 44/66 |
| 4,304,678 | 12/1981 | Schick et al. | 252/56 |
| 4,358,385 | 11/1982 | Zoleski et al. | 252/32.7 |
| 4,368,129 | 1/1983 | Horodysky et al. | 252/32.7 |
| 4,380,498 | 4/1983 | Kammann et al. | 252/48.6 |
| 4,380,499 | 4/1983 | Kammann et al. | 252/48.6 |
| 4,400,284 | 8/1983 | Jessup et al. | 252/49.6 |
| 4,406,802 | 9/1983 | Horodysky et al. | 252/49.6 |
| 4,439,336 | 3/1984 | Zaweski | 252/32.7 |
| 4,485,044 | 11/1984 | Kammann, Jr. et al. | 260/399 |
| 4,495,088 | 1/1985 | Liston | 252/32.7 |
| 4,505,829 | 3/1985 | Wisotsky | 252/32.7 |
| 4,536,308 | 8/1985 | Pehler et al. | 252/32.7 |
| 4,734,211 | 3/1988 | Kennedy | 252/51.5 |
| 4,764,296 | 8/1988 | Kennedy | 252/334 |
| 4,960,528 | 10/1990 | Everett | 252/32 |
| 4,960,530 | 10/1990 | Everett | 252/32.7 R |

OTHER PUBLICATIONS

Ferro Keil Chemical Division product information comprising three undated sheets.

*Primary Examiner*—Prince E. Willis
*Assistant Examiner*—Ellen McAvoy
*Attorney, Agent, or Firm*—David M. Bunnell

[57] ABSTRACT

Lubricant compositions comprising an oil of lubricating viscosity and a cosulfurized blend of (a) a carboxylic acid ester material and (b) an ester, amide, ester-amide or fatty amine derivative which contains at least one polar substituent group such as amino and hydroxyl.

43 Claims, No Drawings

LUBRICATING OIL COMPOSITION

RELATED APPLICATIONS

This application is a Continuation-in-Part of Application Ser. No. 281,262 filed Dec. 7, 1988, now U.S. Pat. No. 4,960,530 which is a Continuation-in-Part of abandoned Application Ser. No. 175,761 filed Mar. 31, 1988.

BACKGROUND OF THE INVENTION

This invention relates generally to lubricant oil compositions which contain additives to reduce friction and wear and inhibit deterioration of the oil and more specifically to such compositions which contain cosulfurized blends of certain organic esters, amines and amides which contain at least one and preferably two polar substituent groups.

The performance requirements for lubricants used in various applications such as internal combustion engine lubrication, gear lubrication, and functional fluids such as hydraulic and automatic transmission fluids are constantly being made more stringent by the manufacturers of products using these lubricants. For example, the smaller engines in use today require motor oils of higher over-all performance, such as with respect to reducing sludge formation. One problem associated with formulating such high performance oils is the precipitation of ingredients due to a lack of compatibility of the various additives, especially in the additive package concentrates which are used in making the finished oils. The invention provides high performance lubricants with excellent friction, anti-wear and/or anti-sludge properties while minimizing such precipitation.

SUMMARY OF THE INVENTION

In accordance with this invention there is provided a lubricant composition comprising an oil of lubricating viscosity, and a cosulfurized blend which includes (a) a carboxylic acid ester material and (b) an ester, amide, ester-amide or fatty amine derivative which contains at least one polar substituent group, wherein the ester derivative according to (b) is derived from an organic acid selected from fatty acids, dialkyl phosphorus acids, thiophosphorus acids, and alkylsulfonic acids, and a compound selected from an oxyalkylated amine or a polyhydric alcohol, provided that when the organic acid is a fatty acid the compound is an oxyalkylated amine. Preferably, the derivative contains two or more polar groups selected from hydroxyl and primary or secondary amino including combinations thereof.

Also provided are methods for reducing wear and/or sludge using the above compositions.

Also provided are novel cosulfurized blends which are useful in forming the above compositions which blends include a carboxylic acid ester material and an ester, amide, ester-amide or fatty amine derivative which contains at least one polar group and which is selected from the group consisting of:

A. a fatty acid amide of a polyamine of the formula:

$$NH_2(CH_2)_n—(NH(CH_2)_n)_m—NH_2$$

wherein n=2 or 3, and m is 0 to 10;

B. a fatty acid partial ester of a polyhydric alcohol;

C. a phosphoramide, of an oxy- or thio-alkyl phosphorous acid with an oxyalkylated amine or a polyamine;

D. an ester of an oxy- or thio-alkyl phosphorous acid with an oxyalkylated amine or a polyhydric alcohol;

E. an ester-amide of an oxy- or thioalkyl phosphorous acid with an oxyalkylated amine;

F. a sulfonamide of an alkylsulfonic acid with an oxyalkylated amine or a polyamine;

G. an ester of an alkylsulfonic acid with a polyhydric alcohol;

H. a compound of the formula:

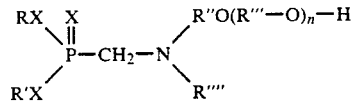

wherein X is selected from sulfur and oxygen including various combinations thereof; R and R′ are independently selected from hydrocarbyl radicals containing from about 4 to 20 carbons; R″ and R‴ are divalent aliphatic hydrocarbon radicals containing 2–4 carbon atoms, n is an integer from 0 to 20 and R⁗ is selected from hydrogen and the group —R″O(R″O)$_n$—H.

I. a fatty amine derivative which contains at least one free hydroxyl group.

DETAILED DESCRIPTION

Carboxylic acid ester materials suitable for preparing the cosulfurized blends include $C_1$–$C_{20}$ alkyl esters of $C_8$–$C_{24}$ unsaturated fatty acids such as palmitoleic, oleic, ricinoleic, petroselinic, vaccenic, linoleic, linolenic, oleostearic, licanic, paranaric, tariric, gadoleic, arachidonic, cetoleic, etc. Other fatty acid ester materials obtained from animal fats and vegetable oils, such as tall oil, linseed oil, olive oil, castor oil, peanut oil, rope oil, fish oil, sperm oil, coconut oil, lard oil, soybean oil and mixtures thereof, can also be used in the present invention.

Exemplary fatty esters include lauryl tallate, methyl oleate, ethyl oleate, lauryl oleate, cetyl oleate, cetyl linoleate, lauryl ricinoleate, oleyl linoleate, oleyl stearate, and alkyl glycerides. The fatty esters can contain other substituents such as hydroxyl or sulfo which can be naturally occurring, for example ricinoleic (12-hydroxyoleic) acid or introduced into the carbon chain such as by reaction with sulfur trioxide.

Sulfurized fatty acid ester materials can also be used in preparing the blends. The sulfurized fatty acid ester materials are prepared by reacting sulfur, sulfur monochloride, and/or sulfur dichloride with the fatty ester under elevated temperatures. A specific example of a useful sulfurized carboxylic acid ester material comprises sulfurized, transesterified, triglycerides derived from fatty acids and fatty oils (e.g. oils selected from coconut, lard, tallow, palm, soybean, and peanut oils and mixtures thereof). Examples of such material are disclosed in U.S. Pat. No. 4,380,499 whose disclosure is incorporated herein by reference. The acid moiety of the triglycerides disclosed in the patent consists of an acid mixture having no more than about 65 mole % unsaturated acids, mainly mono-unsaturated, and no less than about 35 mole % saturated aliphatic acids. Of the total acid moiety, less than about 15 mole % are saturated acids having 18 or more carbon atoms and more than about 20 mole % are saturated acids having 6 to 16 carbon atoms including more than about 10 mole % saturated aliphatic acids having 6 to 14 carbon atoms.

Less than about 15 mole % are poly-unsaturated acids and more than about 20 mole % are mono-unsaturated acids. Solubilizing agents such as unsaturated esters and olefins can be incorporated in the material. Such materials are commercially available, for example, from Keil Chemical Divisions of Ferro Corporation under the trademark SUL-PERM ® 307.

The term "organic acid" as used herein includes aliphatic carboxylic acids, organic phosphorus acids, and organic sulfur acids.

Examples of the types of organic acid ester, amide and ester-amide derivatives suitable for use in conjunction with the carboxylic acid ester material to form the cosulfurized blends include:

A. fatty acid esters, fatty acid amides and fatty acid ester-amides of an oxyalkylated amine or mixtures thereof, said amine having the formula:

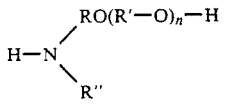

wherein R is a divalent aliphatic hydrocarbon radical containing 1–4 carbon atoms, R′ is a divalent aliphatic hydrocarbon radical containing 1–4 carbon atoms (preferably 2–4), n is an integer from about 0 to 20, preferably 0 to 10, and R″ is selected from hydrogen and the group $—RO(R'O)_n—H$.

Optionally, the fatty acid moiety can be sulfurized. Such sulfurized compounds can be made by reacting a sulfurized fatty acid with an oxyalkylated amine (e.g. diethanolamine) as disclosed, for example, in U.S. Pat. No. 4,201,684 whose teachings are incorporated by reference. Sulfurized fatty acids can be made by heating a mixture of fatty acid with elemental sulfur at temperatures of from about 100° to 250° C. with or without a catalyst such as 2,5-dimercapto-1,3,4,thiadiazole (DMTD) as known in the art.

Another method is to first make the fatty acid ester, amide or ester-amide by reacting a fatty acid with an oxyalkylated amine (e.g. diethanolamine) as disclosed, for example, in U.S. Pat. No. 4,208,293 whose teachings are incorporated by reference, and then reacting that intermediate with elemental sulfur at elevated temperature (e.g. 100° to 250° C.) with or without a catalyst such as DMTD.

The ester, ester-amide, and amide components can be separated by distillation and used separately in lubricating oil compositions or they can be used as mixtures. When equal mole mixtures of fatty acid and dialkanolamine are reacted, very little ester-amide forms and the product contains mainly amide because of the greater reactivity of the HN< group. However, when over one mole of fatty acid is reacted with a mole of dialkanolamine increased amounts of ester-amide can form.

The preferred amines used to make the compounds are alkoxylated amines such as methanolamine, ethanolamine, dimethanolamine, diethanolamine, 2-isopropanolamine and the like. As stated previously, these can be reacted to form both amides, esters and ester-amides. Using diethanolamine as an example, sulfurized oleic acid, (S)oleic reacts as follows:

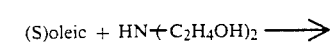

-continued

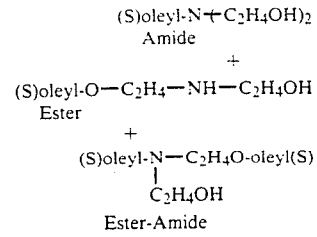

The compounds can be further reacted with alkylene oxide as described in U.S. Pat. No. 4,201,684 to form a polyoxyalkylene chain $[(R'—O)_n$ as defined above in the formula for the amine where R′ contains 2–4 carbons $n>1]$. Preferred fatty acids used in making the amide, ester, ester-amide compounds are those containing about 8–20 carbon atoms. Examples of these are hypogeic acid, oleic acid, linoleic acid, elaidic acid, abietic acid, dihydroabietic acid, dehydroabietic acid, tall oil fatty acids, erucic acid, brassidic acid, caprylic acid, pelargonic acid, capric acid, undecylic acid, lauric acid, tridecoic acid, myristic acid, palmitic acid, stearic acid, arachidic acid and mixtures thereof.

Most preferably, the fatty acid component is a mixture of acids derived from coconut oil.

B. Fatty acid amides of polyamines represented by the formula:

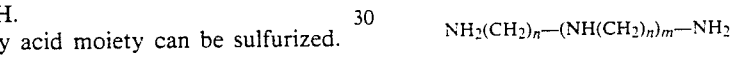

where n=2 or 3 and m is 0 to 10. Specific examples of suitable amines include ethylene diamine, diethylene triamine, triethylene tetramine, tetraethylene pentamine, and pentaethylene hexamine. Preferred fatty acids are those described in (A) above which can be sulfurized. The fatty acid amides can be prepared by reacting the fatty acid with the amine as known in the art. For example, oleic acid with diethylene triamine as follows:

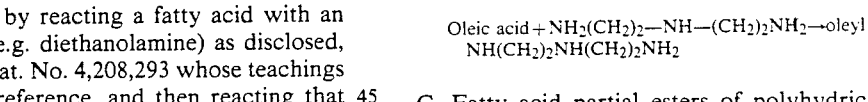

C. Fatty acid partial esters of polyhydric alcohols which preferably contain 2 to 4 free hydroxyl groups. Suitable polyhydric alcohols for forming the esters contain 3 to about 6 hydroxyl groups and include, for example, glycerol, diglycerol, pentaerythritol, trimethylolethane, trimethylolpropane, 1,2,4-butanetriol, 1,2,6-hexanetriol, sorbitol and mannitol and the like. The esters are formed by reacting the polyhydric alcohol with a fatty acid such as described in (A) above at mole ratios to provide a partial ester which contains at least one and preferably two or more free hydroxyl groups. A preferred ester is glycerol monooleate which is commercially available. The glycerol esters can also be obtained by partial saponification of fatty oils. Oxyalkylated derivatives can also be used such as are formed by the reaction of glycerol monooleate with ethylene oxide.

D. Phosphoramides, esters and amine derivatives of oxy- and thio-alkyl phosphorus acids with (1) oxyalkylated amines as described in (A) above, (2) polyamines as described in (B) above, and (3) polyhydric alcohols as described in (D) above. The amide and ester compounds can be formed, for example, by reacting the amine or alcohol with an acid chloride of a dialkyl phosphorus acid of the formula:

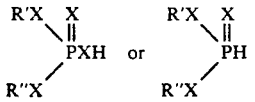

where R' and R'' are independently selected from hydrocarbyl radicals containing from about 4 to 20 carbons and X is selected from oxygen and sulfur including various combinations thereof. The hydrocarbyl group is preferably selected from $C_8$–$C_{20}$ alkyl or alkenyl to provide oil solubility. As in the case of the Class A materials, the reaction of the acids and oxyalkylated amines forms not only amides but esters and ester-amides. The dialkyl phosphorus acids can be prepared, for example, by reacting one or more alcohols, containing about 4 to 20 carbons, such as n-butanol, isobutanol, t-butanol, 2-butanol, pentanol, hexanol, cyclohexanol, 2-ethylhexanol, 1-decanol, 1-dodecanol, cetyl alcohol, and stearyl alcohol with an inorganic phosphorus acid anhydride such as phosphorus pentoxide or phosphorus pentasulfide as is known in the art. The acid chlorides can be prepared by reaction of the acid with chlorine as known in the art, for example:

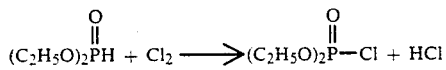

The amine derivatives which can also be considered as being esters of the phosphorus acid can be prepared by reacting a dialkylphosphate with formaldehyde and a dialkanol amine, for example, as follows:

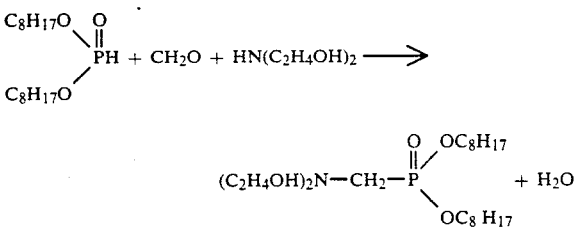

E. Sulfonamides and esters of alkylsulfonic acids with (1) oxyalkylated amines as described in (A) above, (2) polyamines as described in (B) above, and (3) polyhydric alcohols as described in (D) above. The alkyl group of the sulfonic acid generally contains from about 4 to 50 carbons, and preferably at least about 8 carbons for oil solubility, and can be a straight or branched chain. Suitable alkyl groups include polyalkenes such as polyisobutylene (PIB) having a molecular weight, $M_n$, of from about 250 to 5000. Sulfonamides can be formed by reacting the corresponding sulfonyl chloride with the amine or alcohol for example as follows:

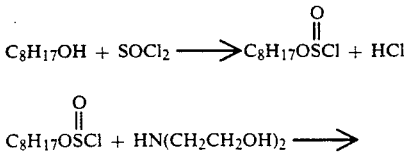

-continued

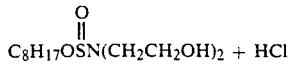

Other derivatives can be prepared by reacting alkylenes or alcohols with sulfur trioxide to form a sulfonic acid intermediate which is then reacted with an amine, for example as follows:

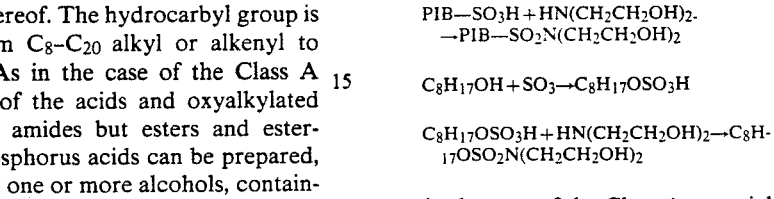

As in the case of the Class A materials the reaction of the sulfuric acid derivative and oxyalkylated amines forms not only amides but esters and ester-amides by reaction of the acid with the hydroxyl groups on the amine.

Suitable fatty amines for use in the invention include fatty amines of the formula:

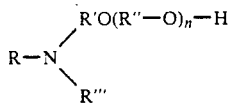

wherein R is an aliphatic hydrocarbon group containing about 12–36 carbon atoms, R' is a divalent aliphatic hydrocarbon radical containing 1–4 carbon atoms, R'' is a divalent aliphatic hydrocarbon radical containing 1–4 carbon atoms (preferably 2–4), n is an integer from 0 to 20, preferably 1–10, and R''' is selected from hydrogen and the group $—R'O(R''—O)_n—H$. Examples of such amines are described, for example in U.S. Pat. No. 4,231,883 whose teachings are incorporated by reference. Such amines include N,N-bis(2-hydroxyethyl)-oleylamine, N,N-bis(2-hydroxyethoxyethyl)-1-methylundecylamine, and N-(2-hydroxyethyl)-N-(2-hydroxyethoxyethyl)-n-dodecylamine.

Other similar esters and amides of the organic acids which contain at least one polar substituent group can also be used provided they have sufficient solubility in oils when cosulfurized with the fatty acid ester materials. The derivatives can be sulfurized prior to cosulfurization but this is not necessary.

The materials which are useful in forming the cosulfurized blends with fatty acid esters and especially the diol containing materials can be further reacted with a boronating agent such as boron acids, e.g. $H_3PO_3$, and boron oxides, e.g. $B_2O_3$, and such boronated materials are considered to be within the scope of this invention.

In order to form the cosulfurized products, the carboxylic acid ester material and the fatty amine, organic acid ester, amide and ester-amide derivative are mixed in proportions of from about 20 to 80 percent by weight of carboxylic acid ester material and from about 80 to 20 percent by weight of the fatty amine, organic ester and/or amide derivative (preferably in a range of 40–60 percent of each component) based on the weight of the mixture, and then heated with from about 1 to 10 percent by weight of elemental sulfur based on the total weight of mixture at a temperature of from about 100° to 250° C. and preferably from about 140° to 180° C. with or without a catalyst for from about ½ to 2 hours. Suitable catalysts as known in the art include 2,5-dimercapto- 1,3,4-thiadiazole DMTD and alkyl amines such as PRIMENE® 81-R ($RC(CH_3)_2NH_2$ where R is $C_{12}$–$C_{14}$) The cosulfurized mixtures preferably contain from about 2 to 10 percent by weight sulfur and most preferably from about 5 to 7 percent by weight with the amount of elemental sulfur in the reaction being adjusted to provide the desired sulfur content.

A composition according to the Class A compounds is commercially available. It contains about 6 weight percent sulfur, and consists essentially of a high temperature blend having a common sulfur linkage of sulfurized esters of mixed animal and vegetable oils comprising transesterified triglycerides containing a mixture of saturated and mono- and polyunsaturated monobasic acids in which most of the free acid has been esterified with mono-alcohols (approximately 60% by weight) as disclosed in U.S. Pat. No. 4,380,499 (Keil SP307) and the reaction product of diethanolamine and fatty acids derived from selected acids and oils including coconut oil (approximately 40% by weight) (Keil KDP 55-271 whose iodine number is 7.3 centigrams $I_2$ per gram of fatty product which indicates a largely saturated product) is available from the Keil Chemical Division of Ferro Corporation under the trademark "SULPERM® 60-93".

The cosulfurized blends can be used in mineral oil or in synthetic oils of suitable viscosity for the desired lubricant application. Crankcase lubricating oils have a viscosity up to about 80 SUS at 210° F.

Preferred crankcase lubricating oils for use in the invention have a viscosity up to about SAE 40. Sometimes such motor oils are given a classification at both 0° and 210° F., such as SAE 10W or SAE 5W30.

Mineral oils include those of suitable viscosity refined from crude oil from all sources including Gulfcoasts, midcontinent, Pennsylvania, California, Alaska and the like. Various standard refinery operations can be used in processing the mineral oil.

Synthetic oil includes both hydrocarbon synthetic oil and synthetic esters. Useful synthetic hydrocarbon oils include polymers of alpha-olefins having the proper viscosity. Especially useful are the hydrogenated liquid oligomers of $C_{6-12}$ alpha-olefins such as alpha-decene trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are didodecyl adipate, trimethylol propane tripelargonate, pentaerythritol tetracaproate, di-(2-ethylhexyl)adipate, dilauryl sebacate and the like. Complex esters prepared from mixtures of mono- and dicarboxylic acid and mono- and polyhydroxyl alkanols can also be used.

Blends of mineral oil with synthetic oil are also useful. For example, blends of 5–25 wt.% hydrogenated alpha-decene trimer with 75–95 wt.% 150 SUS (100° F.) mineral oil. Likewise, blends of about 5–25 wt.% di-(2-ethylhexyl)adipate with mineral oil of proper viscosity results in a useful lubricating oil. Also, blends of synthetic hydrocarbon oil with synthetic esters can be used. Blends of mineral oil with synthetic oil are useful when preparing low viscosity oil (e.g. SAE 5W30) since they permit these low viscosities without contributing excessive volatility.

The amounts of cosulfurized blend in the lubricating oil generally range from about 0.05 to about 6.0 percent by weight for crankcase applications (preferred 0.3 to 3.5) based on the total weight of lubricating oil composition although larger amounts can be used depending upon the application, e.g. up to about 20 percent by weight.

The lubricating oil compositions of the present invention for crankcase use preferably contain an overbased alkaline earth metal sulfonate, zinc dithiophosphate and an ashless dispersant. They can also contain any of the other additives conventionally added to such compositions such as, for example, wear-inhibiters, friction reducers, viscosity index improvers, antioxidants, dispersants, detergents such as neutral alkaline earth metal sulfonates, antifoam agents, pour point depressants and the like provided, of course, that the presence of such additional additives in the compositions does not significantly interfere with the benefits provided by the additives of the present invention.

A combination of overbased alkaline earth metal sulfonate and zinc dihydrocarbyl dithiophosphate along with the cosulfurized materials provide enhanced antiwear properties. The combination of an ashless dispersant and the cosulfurized blends of the invention provide synergistic anti-sludge properties.

Suitable overbased alkaline earth metal sulfonates have a base number of at least 100, more preferably at least about 300. The "total base number" (TBN) also referred to as "base number" is a measure of the alkaline reserve in the product in terms of its stoichiometric equivalent of mg KOH per gram of product (ASTM D2896).

Overbased alkaline earth metal sulfonates are derived from sulfonic acids, particularly from petroleum sulfonic acids, polyalkylene sulfonic acids or alkylated benzene sulfonic acids. Useful sulfonic acids from which the overbased alkaline earth metal sulfonates are prepared have an average molecular weight of about 250–5000, more preferably about 400–1100, and most preferably about 440–600. Examples of specific sulfonic acids include mahogany sulfonic acids, petrolatum sulfonic acids, aliphatic sulfonic acids and cycloaliphatic sulfonic acids. In a highly preferred embodiment, the sulfonic acids are alkaryl sulfonic acids such as alkylbenzene or alkylnaphthalene sulfonic acids. Suitable alkyl groups contain from 10 to about 30 carbon atoms or more. Likewise, higher molecular weight alkyls derived from alkylation with polyolefin (e.g. polybutenes) having molecular weights up to about 2000 can be used to give hydrocarbyl sulfonic acids somewhat above the preferred range, but still useful.

Preferred sulfonic acids are the alkaryl sulfonic acids also referred to as alkylbenzene sulfonic acids.

Alkaryl sulfonic acids can be made by conventional methods such as by alkylating benzene, toluene or naphthalene or aromatic mixtures with olefins containing about 10–30 carbon atoms or more (e.g. with polyolefin). The most suitable olefins are cracked-wax olefins, propylene trimers and tetramers and olefin mixtures derived from aluminum alkyl chain growth. Alkylation is effected using a Friedel-Crafts (e.g. $AlCl_3$ or $BF_3$) catalyst. The alkylaromatic mixture contains predominantly mono- and di-alkyl products. These alkyl aromatics are then sulfonated by known methods such as by reaction with sulfuric acid, oleum, sulfur trioxide and the like.

Thus, preferred sulfonic acids include octadecylbenzene sulfonic acid, didodecylbenzene sulfonic acid, docosylbenzene sulfonic acid, triacontylbenzene sulfonic acid, dodecyloctadecyl-benzene sulfonic acid, didecylbenzene sulfonic acid, dodecylnaphthalene sulfonic acid, hexadecylnaphthalene sulfonic acid, dinonylbenzene sulfonic acid and mixtures thereof and the like.

The hydrocarbyl sulfonic acids preferably have an average molecular weight of about 250–5000. More preferred are the alkylbenzene sulfonic acids having an average molecular weight of about 400–1100 and most preferably 440–600.

The overbased alkaline earth metal sulfonates are produced by neutralizing the sulfonic acid with an alkaline earth metal base to form an alkaline earth metal sulfonate salt and then overbasing the alkaline earth metal sulfonate with the corresponding alkaline earth metal carbonate. The process is conducted to give a total base number of at least 100, more preferably at least 300. There is no real maximum on total base number, but for practical purposes they seldom exceed about 550.

Overbased calcium petroleum sulfonates or alkaryl (e.g. alkylbenzene) sulfonates are especially preferred. These are prepared by neutralizing the corresponding petroleum sulfonic acid or alkylated benzene sulfonic acid with a calcium base to form a calcium sulfonate salt and then overbasing the calcium sulfonate with calcium carbonate generally by passing carbon dioxide through a mixture of the neutral calcium sulfonate, mineral oil, lime and water.

Such additives are available commercially. For example, an overbased calcium sulfonate produced from a synthetic benzene sulfonic acid having a TBN of 310 can be obtained from Ethyl Petroleum Additives, Inc. under the designation HiTEC® 611.

Useful zinc dihydrocarbyldithiophosphates (ZDDP) include both zinc dialkyldithiophosphates and zinc dialkaryldithio- phosphates as well as mixed alkyl-aryl ZDDP. A typical alkyl-type ZDDP contains a mixture of isobutyl and isoamyl groups. Zinc dinonylphenyldithiophosphate is a typical aryl-type ZDDP.

Preferred zinc dithiophosphate components are represented by the formula:

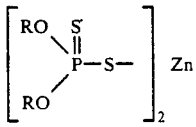

in which R is a hydrocarbyl radical having from 3 to 12 carbon atoms. The most preferred zinc dithiophosphates are those in which R represents an alkyl radical having from 3 to 8 carbon atoms such as isopropyl, isobutyl, isoamyl and 2-ethylhexyl. Examples of suitable compounds include zinc isobutyl 2-ethylhexyl dithiophosphate, zinc di(2-ethylhexyl)dithiophosphate, zinc isopropyl 2-ethylhexyl dithiophosphate, zinc isoamyl 2-ethylhexyl dithiophosphate and zinc dinonylphenyldithiophosphate.

Such additives are also available commercially. For example, a mixed 2-ethylhexyl, 2-methylpropyl, isopropyl ester of phosphorodithioic acid, zinc salt can be obtained from Ethyl Petroleum Additives, Inc. under the designation HiTEC® 685.

Most preferred crankcase oils also contain an ashless dispersant such as the polyolefin-substituted succinamides and succinimides of polyethylene polyamines such as tetraethylenepentamine. The polyolefin succinic substituent is preferably a polyisobutene group having a number average molecular weight of from about 800 to 5,000 and preferably from about 1,000 to 2,000. Such ashless dispersants are more fully described in U.S. Pat. No. 3,172,892, U.S. Pat. No. 3,219,666 and U.S. Pat. No. 4,234,435 incorporated herein by reference.

Another useful class of ashless dispersants are the polyolefin succinic esters of mono-and polyhydroxyl alcohols containing 1 to about 40 carbon atoms. Such dispersants are described in U.S. Pat. No. 3,381,022 and U.S. Pat. No. 3,522,179.

Likewise, mixed ester/amides of polyolefin substituted succinic acid made using alkanols, amines and/or aminoalkanols represent a useful class of ashless dispersants.

The succinic amide, imide and/or ester type ashless dispersants may be boronated by reaction with a boron compound such as boric acid. Likewise, the succinic amide, imide and/or ester may be oxyalkylated by reaction with an alkylene oxide such as ethylene oxide or propylene oxide.

Other useful ashless dispersants include the Mannich condensation products of polyolefin-substituted phenols, formaldehyde and polyethylene polyamine. Preferably, the poly olefin phenol is a polyisobutylene-substituted phenol in which the polyisobutylene group has a molecular weight of from about 800 to 5,000. The preferred polyethylene polyamine is tetraethylene pentamine. Such Mannich ashless dispersants are more fully described in U.S. Pat. No. 3,368,972; U.S. Pat. No. 3,413,347; U.S. Pat. No. 3,442,808; U.S. Pat. No. 3,448,047; U.S. Pat. No. 3,539,633; U.S. Pat. No. 3,591,598; U.S. Pat. No. 3,600,372; U.S. Pat. No. 3,634,515; U.S. Pat. No. 3,697,574; U.S. Pat. No. 3,703,536; U.S. Pat. No. 3,704,308; U.S. Pat. No. 3,725,480; U.S. Pat. No. 3,726,882; U.S. Pat. No. 3,736,357; U.S. Pat. No. 3,751,365; U.S. Pat. No. 3,756,953; U.S. Pat. No. 3,793,202; U.S. Pat. No. 3,798,165; U.S. Pat. No. 3,798,247; and U.S. Pat. No. 3,803,039.

The above Mannich dispersants can be reacted with boric acid to form boronated dispersants having improved corrosion properties.

Viscosity index improvers can be included such as the polyalkylmethacrylate type or the ethylene-propylene copolymer type including graft copolymers with an N-allyl amide such as diallyl formamide. Likewise, styrene-diene VI improvers or styrene- acrylate copolymers can be used. Alkaline earth metal salts of phosphosulfurized polyisobutylene are useful.

Conventional blending equipment and techniques may be used in preparing the lubricating oil compositions of the present invention. In general, a homogeneous blend of the foregoing active components is achieved by merely blending the components separately, together or in any combination or sequence with the lubricating oil in a determined proportion sufficient to provide the lubricating oil composition with the desired properties. This is normally carried out at ambient temperature to about 70° C. The selection of the particular base oil and components, as well as the amounts and ratios of each depends upon the contemplated application of the lubricant and the presence of other additives. In general, however, the amount of overbased alkaline earth metal sulfonate in the lubricating oil can vary from about 0.5 to 5.0, and usually from about 0.75 to 2.5 weight percent based on the weight of the final composition. The amount of zinc dihydrocarbyl dithiophosphate in the lubricating oil can vary from about 0.5 to 3.0, and usually from about 1.0 to 2.0 weight percent based on the weight of the final composition. The amount of ashless dispersant in the lubricating oil can vary from about 2 to 8, and usually from about 3 to 6 weight percent based on the weight of the final composition. The amount of cosulfurized blend in the lubricating oil can vary from about 0.05 to 6.0, and usually from about 0.3 to 3.5 weight percent based on the weight of the final composition.

In many cases, a preferred way to add the additives to lubricating oil is in the form of an additive package. These are concentrates dissolved in a diluent such as mineral oil, synthetic hydrocarbon oils and mixtures thereof which, when added to a base oil, will provide an effective concentration of the present additives and other known conventional additives such as those listed above. The various additives are present in a proper ratio such that when a quantity of the concentrate is added to lubricating oil the various additives are all present in the proper concentration. For example, if the desired use level of a particular additive component is 0.2 wt. % and the final formulated oil is made by adding 10 parts of the additive package to 90 parts of base lubricating oil, then the additive pack will contain 2.0 wt. % of that particular additive component. Usually the concentrate will be 95.0 to 99.9 percent by weight additive composition and from 5.0 to 0.1 percent by weight lubricating oil diluent. Preferably, the additive composition comprises 97 to 99 percent by weight of the lubricating oil additive concentrate. This concentrate is diluted with additional lubricating oil before use such that the finished lubricating oil product contains from about 5.0 to 25.0 percent by weight of concentrate. Accordingly, typical amounts of ashless dispersant in a concentrate would range from about 40 to 60 weight percent of total concentrate and typical amounts of ZDDP or overbased alkaline earth metal sulfonate would range from about 10 to 20 weight percent of total concentrate.

The following examples illustrate the preparation of cosulfurized blends for use in lubricants.

EXAMPLE 1

A mixture of 60 grams of coconut oil fatty acid diethanol amide (Schercomid® SCO-extra), 90 grams of soybean oil, 9.57 grams of sulfur and 0.80 gram of 2,5-dimercapto-1,3,4-thiadiazole (DMTD) as catalyst are heated at about 160° C. for 30 minutes with stirring while allowing water vapor to escape and then cooled to avoid side reactions. The product contains 6% by weight sulfur.

EXAMPLE 2

A mixture of 60 grams of glycerol monooleate, 90 grams of coconut oil, 9.57 grams of sulfur and 0.80 gram of DMTD as catalyst are heated at about 160° C. for about 2 hours with stirring. About 159 grams of product is recovered and filtered to remove a small amount of dark precipitate.

EXAMPLE 3

A mixture of 60 grams of glycerol monooleate, 90 grams of soybean oil, 9.57 grams of sulfur and 0.80 gram of DMTD as catalyst are heated at about 160° C. for 30 minutes with stirring. About 157 grams of product is recovered.

EXAMPLE 4

A reaction product of glycerol monooleate and ethylene oxide is prepared by mixing 3.0 grams of catalyst (Amberlyst® 15 Mallinckrodt) and 150 grams of glycerol monooleate in a flask equipped with a stirrer, gas inlet tube, dry ice-isopropyl alcohol condenser and thermometer and heated to 100° C. Ethylene oxide is fed to the reaction mixture through the gas inlet tube for about 3 hours at temperatures of from about 40° to 107° C. The weight increase of the reaction mixture is about 5.2 grams indicating the combination of that amount of ethylene oxide with the glycerol monooleate. The product is filtered and cosulfurized with soybean oil according to the following procedure.

A mixture of 60 grams of the glycerol monooleateethylene oxide product prepared above, 90 grams of soybean oil, 9.57 grams of sulfur and 0.80 gram of DMTD is heated with stirring at from about 158° to 167° C. for 30 minutes to prepare a cosulfurized blend of the soybean oil and glycerol monooleate-ethylene oxide product.

EXAMPLE 5

To 100 grams (0.327 mole) of di-2-ethylhexyl) phosphonate in 100 ml $CCl_4$ solvent is bubbled in 99.6 grams of chlorine to form di-2-ethylhexyl phosphorochloridate with HCl off-gas removed in a scrubber. The reaction is exothermic and the temperature rises to from about 43° to 56° C. The solvent is stripped (vacuum+53° C.) to provide 113.34 grams of product (111.3 theory). Equimolar portions of the chloridate product and diethylanolamine can then be reacted at reflux in 100 ml tetrahydrofuran solvent to form the amide. The HCl is either evolved or removed by washing the product with base.

The di-2-ethylhexylphosphorodiethanol amide can then be reacted with a fatty oil such as soybean or coconut oil and elemental sulfur as described in the foregoing examples to form a cosulfurized blend.

Similarly, the sulfur analog, di-2-ethylhexyl-dithiophosphorochloridate, can be prepared, reacted with diethanol amine to form the amide and then cosulfurized with soybean or coconut oil.

EXAMPLE 6

Equimolar portions of 2-ethylhexyl alcohol (100 gms, 0.775 mole) and thionyl chloride (92.2 grams, 0.775 mole) are reacted by slowly adding the thionyl chloride to the alcohol with removal of HCl. The 2-ethylhexyl chlorosulfite product (100 grams, 0.473 mole) can then be treated with (49.6 grams, 0.473 mole) of diethanolamine with HCl removal to provide the amide product which is cosulfurized with soybean or coconut oil in accordance with the process described in the foregoing examples.

EXAMPLE 7

A reaction product of amine and fatty acid can be prepared by heating (180°-200° C.) a mixture of 100 grams, 0.538 mole, of coconut oil fatty acid and 55.4 grams, 0.538 mole of diethylene triamine. The product is expected to be a mixture of primary and secondary amides. The product can then be cosulfurized by reaction with sulfur and soybean or coconut oil following the procedures described in the foregoing examples.

The following formulation illustrates a typical additive mixture within the scope of this invention. Parts are by weight.

Zinc dialkyldithiophosphate: 0.5–3.0 parts

Overbased calcium alkylbenzene sulfonate (TBN 310): 0.5–5.0 parts

SUL-PERM ® 60-93: 0.05–6.0 parts.

The lubricity or wear properties of the lubricating oil compositions of the present invention were determined in the 4-Ball Wear Test. This test is conducted in a device comprising four steel balls, three of which are in contact with each other in one plane in a fixed triangular position in a reservoir containing the test sample. The fourth ball is above and in contact with the other three. In conducting the test, the upper ball is rotated while it is pressed against the other three balls while pressure is applied by weight and lever arms. The diameter of the scar on the three lower balls is measured by means of a low power microscope, and the average diameter measured in two directions on each of the three lower balls is taken as a measure of the anti-wear characteristics of the oil. A larger scar diameter means more wear. The balls were immersed in base lube oil containing the test additives. Applied load was 40 kg and rotation was at 1,800 rpm for 30 minutes at 130° F. Tests were conducted both with base oil alone (Exxon 100 neutral low pour base stock mineral oil) and with lube oil blends having the following compositions:

Blend A = Base oil containing 1.2 wt. % zinc dialkyldithiophosphate (HiTEC ® 685).

Blend B = Base oil containing 1.3 wt. % overbased calcium alkylbenzene sulfonate, TBN 310 (HiTEC ® 611).

Blend C = Base oil containing 0.5% wt. % SUL-PERM ® 60-93.

Blend D = Base oil containing 1.2 wt. % zinc dialkyldithiophosphate (HiTEC ® 685) + 0.5 wt. % SUL-PERM ® 60-93.

Blend E = Base oil containing 1.2 wt. % zinc dialkyldithiophosphate (HiTEC ® 685) + 1.3 wt. % overbased calcium alkylbenzene sulfonate, TBN 310 (HiTEC ® 611).

Blend F = Base oil containing 1.3 wt. % overbased calcium alkylbenzene sulfonate, TBN 310 (HiTEC ® 611) + 0.5 wt. % SUL-PERM ® 60-93.

Blend G = Base oil containing 1.2 wt. % zinc dialkyldithiophosphate (HiTEC ® 685) + 1.3 wt. % overbased calcium alkylbenzene sulfonate, TBN 310 (HiTEC ® 611) + 0.5 wt. % SUL-PERM ® 60-93.

Results are given in the following table.

| Oil Formulation | Scar Diameter (mm) |
|---|---|
| Base Oil | 1.47 * |
| Blend A | 0.633 |
| Blend B | 0.688 |
| Blend C | 0.527 |
| Blend D | 0.483 |
| Blend E | 0.544 |
| Blend F | 1.658 |
| Blend G | 0.352 |

* The run was terminated after 5 seconds due to excessive vibrations and noise at which time the scar diameter was 1.47 mm.

The results in the table show that Blend G containing all three of the above components gave a scar diameter significantly less than the other blends.

In addition to providing engine wear reduction properties to lubricating oil compositions formulated for use in engine crankcases, the additive combinations of the present invention are also deemed to impart detergency properties to lubricating oils containing same so as to inhibit sludge formation.

Accordingly, the presence of the cosulfurized blend, has been found to provide a compatible lubricant oil additive package which significantly reduces engine sludge formation as determined by laboratory bench and engine testing. Generally, suitable amounts of the blend to inhibit sludge range from about 0.05 to about 6 percent by weight based on the total weight of lubricating oil composition (preferred about 0.3 to 3.5 weight percent). Additive concentrates generally contain from about 2 to 25 percent by weight of such high temperature blend.

Four oil blends were tested in the VE engine test with and without the presence of 0.5 weight % of the SUL-PERM ® 60-93 additive. Blends A', B', and C' are fully formulated 5W30 oils made by combining a base oil with zinc dialkyldithiophosphate ester (ZDDP) antiwear, neutral and overbased calcium sulfonate detergents, alkenylsuccinimide ashless dispersant, antioxidants, antifoam agent pour point depressant, viscosity index (VI) improver and, in Blend C' a rust inhibitor. Blend D' is a fully formulated SAE 30 oil which is made from a base oil containing the above additives except for the VI improver and rust inhibitor.

The results are reported in the following table.

| Blend | VE Sludge Rating[1] Without Additive | VE Sludge Rating With Additive | Effect |
|---|---|---|---|
| A' | 7.79 | 9.15 | +1.36 |
| B' | 7.32 | 9.02 | +1.70 |
| C' | 6.67 | 8.79 | +2.12 |
| D' | 5.98 | 8.98 | +3.00 |

[1]Rating Scale: 10 is a perfectly clear (sludge free) engine 9 is a "pass".

The results in the table show that the presence of the additive significantly improved the sludge rating of all four oil blends. The function of the two ingredients of the sulfurized blend is not exactly understood except that fatty acid diethanol amides (Nippon Cooper FRM-213 or Keil KDP55-271 additives), provided improved four-ball, and laboratory VE sludge bench test results but the additive packages became hazy after standing for 1 day at both room temperature (RT) and at 70° C. which indicated a lack of additive ingredient compatibility which could lead to performance problems due to the precipitation from the concentrate or finished oil of additive material. In contrast, the cosulfurized mixtures of sulfurized fatty acid and diethanolamide (Keil SP60-93 or cosulfurized Keil KDP55-271 and Keil SP307 additives) provided packages which remained clear after, respectively, 6 and 3 days. The co-sulfurized mixture of Schercomid SCO-extra and soybean oil showed only a trace of haze after 28 days at room temperature and was clear at 70° C. after 28 days. The data are recorded in the following table in which the parenthetical amounts represent the weight percent additive.

| Additive | 4 Ball Wear (3-Como)[3] | 4 Ball Wear (Full Pack)[4] | VE Sludge Bench Test[4,5] | Compatibility[6] RT | Compatibility[6] 70° C. |
|---|---|---|---|---|---|
| Coconut Oil Fatty acid diethanol-amide (Keil KDP55-271) | 0.344 mm (.2%) | 0.369 (.2%) | 67.3 (.2%) | Med Haze (1 day) | Med Haze (1 day) |
| Oleyl Fatty acid die-thanolamide (FRM-213 Nippon Cooper) | 0.363 mm (.3%) | 0.369 (.5%) | 68.2 (.2%) | Med Haze (1 day) | Med Haze (1 day) |
| Cosulfurized fatty acid ester (Keil SP307) and fatty acid diethanol-amide (KDP55 271)[1] | 0.358 mm (.5%) | 0.340 (.5%) | 76.5 (.5%) | Clear (3 days) | Clear (3 days) |
| Cosulfurized fatty acid ester and fatty acid diethanol-amine (Keil SP60-93) | 0.365 mm (.5%) | 0.369 (.5%) | 67.1 (.5%) | Clear (6 days) | Clear (6 days) |
| Cosulfurized coconut oil fatty acid diethanol-amide (Scher-comid SCO-extra) and soybean oil[2] | 0.367 mm (.5%) | 0.342 (.5%) | 46.87 (.5%) | Trace Haze (28 days) | Clear (28 days) |
| Control | 0.544 mm (0%) | 0.413 (0%) | 98.5 (0%) | — | — |

[1]Prepared by heating a mixture of 120 grams sulfurized fatty acid ester, 80.0 grams amide, and 4.68 grams of elemental sulfur with 1 gram of 2,5-dimercapto-1,3,4-thiadiazole as catalyst (DMTD) at 160° C. for 2 hours.
[2]Prepared by Example 1.
[3]Similar to Blend G above except with substitution of the listed additive.
[4]Fully formulated SAE 5W30 oil made by adding to base oil, succinimide dispersant, ZDDP antiwear, neutral and overbased calcium sulfonate detergents, antioxidants, antifoam agent, pour point depressant and VI improver.
[5]After 22-30 hours HOOT (Hot Oil Oxidation Test) the change in dielectric constant is determined. The oxidized oil is mixed with a known amount of standard oxidized oil (a laboratory preparation) and diluted with a hydrotreated basestock. Turbidity measurements are then taken. The dielectric constant measurement, HOOT time and turbidity data are combined into a single number for reporting and comparison purposes. A lower number indicates better anti-sludge properties.
[6]Compatibility of the listed additive with a conventional additive package used by oil blenders to prepare finished lubricating oils. The package used contains the same additives as the full pack of note 4 except that no VI improver or pour point depressant is present.
[7]This test was run on a different date from the others. The control gave a value of 77.6 and the run with Keil SP60-93 gave a value of 51.7 indicating a milder test.

An oil blend corresponding to Blend G above was formulated except that the SUL-PERM® 60-93 was replaced by 0.5 weight percent of the cosulfurized glycerol monooleate-soybean oil product prepared according to the process described in Example 3. When tested in the 4-ball wear test, the oil blend gave a wear scar diameter of 0.383 mm. An oil additive concentrate was made which contained 5% by weight of the cosulfurized blend prepared according to Example 3 and also, besides the ZDDP anti-wear agent, neutral and overbased calcium sulfonate detergents, antioxidants, antifoam agent and process oil, about 60% by weight of a 1500 molecular weight succinimide dispersant. Samples kept at different temperatures for 12 weeks were periodically examined for haze and precipitates. Also, fully formulated 5 w 30 oils prepared from the concentrate additive (10% by weight concentration which also contained a pour point dispersant and a viscosity index improver) were tested for haze and precipitates and also for sludge in the VE sludge bench test. The results are reported below where 0 indicates a clear solution, 1 a trace of precipitates or haze, 2 a light precipitate or haze, 3 a medium precipitate or haze, and 4 a heavy precipitate or haze.

| | Concentrate Compatibility | | | | | |
|---|---|---|---|---|---|---|
| | 70° C. | | Room Temperature | | °C. | |
| Time | Haze | PPT | Haze | PPT | Haze | PPT |
| 0 | 0 | 0 | 0 | 0 | 0 | 0 |
| 4 weeks | 0 | 0.5 | 0 | 0 | 0 | 0 |
| 8 weeks | 0 | 0.5 | 0 | 0.5 | 0 | 0 |
| 12 weeks | 0 | 1.0 | 0 | 0.5 | 0 | 0 |

| | Fully Formulated Oil Compatibility | | | | | | |
|---|---|---|---|---|---|---|---|
| | 70° C. | | Room Temperature | | °C. | | VE Sludge Bench |
| Time | Haze | PPT | Haze | PPT | Haze | PPT | Test |
| 0 | 0 | 0 | 0 | 0 | — | — | 55.6 |
| 4 weeks | — | 2.0 | 0 | 2.0 | 0 | 1.0 | (.5%) |
| 8 weeks | 0 | 2.0 | 0 | 1.5 | 0 | 1.0 | (control 77.6) |
| 12 weeks | 0 | 2.5 | 0 | 1.5 | 0 | 1.5 | |

All of the solutions were haze free. The concentrates had no more than a trace of precipitates after 12 weeks with the fully formulated oil giving a trace to a light precipitate after four weeks which did not appreciably increase after 12 weeks. A significant improvement in sludge was obtained (55.6 versus 77.6 for the control).

An oil blend corresponding to Blend G above was formulated except that the SUL-PERM® 60-93 was replaced by 0.5 gram of the cosulfurized blend of glycerol monooleate-ethylene oxide and soybean oil prepared according to the process described in Example 4. When tested in the 4-ball wear test, the oil blend gave a wear scar diameter of 0.371 mm. A fully formulated oil which contained 0.5% by weight of the cosulfurized blend in place of the blend of Example 3 was tested in the VE sludge test and gave a result of 58.1 compared to 77.6 for the control.

What is claimed is:

1. A lubricant composition comprising a major amount of an oil of lubricating viscosity and a minor amount of a cosulfurized blend comprising (a) a carboxylic acid ester material and either (b) an ester, amide, ester-amide or fatty amine derivative which contains at least one polar substituent group, wherein said ester, amide or ester-amide derivative is derived from an organic acid selected from dialkyl phosphorus acids, dialkyl thiophosphorus acids, and alkylsulfonic acids or (c) an amide derived from a fatty acid and a polyamine.

2. A composition according to claim 1 where the ester derivative according to (b) is derived from said organic acid and a compound selected from an oxyalkylated amine or a polyhydric alcohol, the amide derivative according to (b) is derived from said organic acid and an amine selected from an oxyalkylated amine or a polyamine, the ester-amide derivative according to (b) is derived from said organic acid and an oxyalkylated amine, and the fatty amine derivative is an oxyalkylated amine.

3. A composition according to claim 2 wherein the organic acid is selected from dialkyl phosphorus and dialkyl thiophosphorus acids wherein each alkyl group contains from about 4 to 20 carbon atoms, and alkylsulfonic acids wherein the alkyl group contains from about 4 to 50 carbon atoms.

4. A composition according to claim 3 wherein said oxyalkylated amine has the formula:

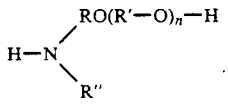

wherein R is a divalent hydrocarbon radical containing 1–4 carbon atoms, R′ is a divalent aliphatic hydrocarbon radical containing 1–4 carbon atoms, n is an integer from 0 to 20 and R″ is selected from hydrogen and the group $—RO(R'O)_n—H$.

5. A composition according to claim 4 wherein said oxyalkylated amine is diethanolamine.

6. A composition according to claim 3 wherein said polyamine has the formula:

$$NH_2(CH_2)_n—(NH(CH_2)_n)_m—NH_2$$

wherein n=2 or 3; and m=0 to 10.

7. A composition according to claim 3 wherein said polyhydric alcohol contains 3 to 6 total hydroxyl groups and at least 2 free hydroxyl groups.

8. A composition according to claim 3 wherein said organic acid is a dialkyl phosphorus acid of the formula:

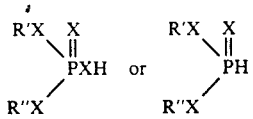

wherein R′ and R″ are independently selected from hydrocarbyl radicals containing 4 to 20 carbons and each X is selected from oxygen and sulfur.

9. A composition according to claim 3 wherein the alkylsulfonic acid contains from about 8 to 50 carbon atoms.

10. A composition of claim 2 wherein the carboxylic acid ester material used to form the blend is sulfurized.

11. A composition of claim 1 wherein the cosulfurized blend contains from about 1 to 10 percent by weight of blend of sulfur.

12. A composition of claim 1 which also contains a minor amount of an ashless dispersant.

13. A composition of claim 12 wherein the ashless dispersant is a polyolefin-substituted succinimide of a polyethylene polyamine.

14. A composition of claim 1 which also contains minor amounts of an overbased alkaline earth metal sulfonate having a total base number of at least 100 and a zinc dihydrocarbyl dithiophosphate.

15. A composition of claim 12 which also contains minor amounts of an overbased alkaline earth metal sulfonate having a total base number of at least 100 and a zinc dihydrocarbyl dithiophosphate.

16. A composition of claim 1 which contains from about 0.05 to 6.0 weight percent based on the weight of composition of said cosulfurized blend.

17. A composition of claim 14 which contains from about 0.5 to 5.0 weight percent based on the weight of composition of said sulfonate, from about 0.5 to 3.0 weight percent based on the weight of composition of said zinc dihydrocarbyl dithiophosphate, and from about 0.05 to 6.0 weight percent based on the weight of composition of said cosulfurized blend.

18. A composition of claim 12 which contains from about 2.0 to 8.0 weight percent based on the weight of composition of said ashless dispersant and from about 0.05 to 6.0 weight percent based on the weight of composition of said cosulfurized blend.

19. A composition of claim 15 which contains, based on the weight of composition, from about 0.05 to 6.0 weight percent of said cosulfurized blend, from about 2.0 to 8.0 weight percent of said ashless dispersant, from about 0.5 to 5.0 weight percent of said sulfonate and from about 0.5 to 3.0 weight percent of said zinc dihydrocarbyl phosphate.

20. A composition according to claim 1 wherein said derivative is a fatty amide of a polyamine of the formula:

$$NH_2(CH_2)_n—(NH(CH_2)_n)_m—NH_2$$

wherein n=2 or 3 and m is 0 to 10.

21. A composition according to claim 1 wherein said derivative contains two or more polar groups selected from hydroxyl, primary amine, and secondary amine.

22. A composition according to claim 1 wherein said derivative is a phosphoramide of an oxy- or thio-alkyl phosphorus acid with an oxyalkylated amine or a polyamine.

23. A composition according to claim 1 wherein said derivative is an ester of an oxy- or thio-alkyl phosphorous acid with an oxyalkylated amine or a polyhydric alcohol.

24. A composition according to claim 1 wherein said derivative is an ester-amide of an oxy- or thioalkyl phosphorous acid with an oxyalkylated amine.

25. A composition according to claim 1 wherein said derivative is a sulfonamide of an alkylsulfonic acid with an oxyalkylated amine or a polyamine.

26. A composition according to claim 1 wherein said derivative is an ester of an alkylsulfonic acid with a polyhydric alcohol.

27. A composition according to claim 1 wherein said fatty acid contains from about 8 to 20 carbon atoms.

28. An additive concentrate adapted for addition to a lubricating oil to provide a formulated lubricating oil suitable for use in the crankcase of an internal combustion engine said concentrate comprising a diluent oil and from about 2.0 to about 25 percent by weight, based on the total weight of concentrate, of a cosulfurized blend comprising (a) a carboxylic acid ester material and either (b) an ester, amide, ester-amide or fatty amine derivative which contains at least one polar substituent group, wherein said ester, amide or ester-amide derivative is derived from an organic acid selected from dialkyl phosphorus acids, dialkyl thiophosphorus acids, and alkylsulfonic acids, or (c) an amide derived from a fatty acid and a polyamine.

29. The concentrate of claim 28 which also contains from about 40 to 60 percent by weight based on the total weight of concentrate of an ashless dispersant.

30. The concentrate of claim 29 which also contains from about 10 to 20 percent by weight based on the total weight of concentration of an overbased alkaline earth metal sulfonate having a total base number of at least 100 and from about 10 to 20 percent by weight based on the total weight of concentrate of a zinc dihydrocarbyl dithiophosphate.

31. A concentrate according to claim 28 wherein said derivative contains two or more polar groups selected from hydroxyl, primary amine, and secondary amine.

32. A method of reducing sludge in an internal combustion engine said method comprising adding to a lubricating oil a sludge inhibiting amount of a cosulfurized blend comprising (a) a carboxylic acid ester material and either (b) an ester, amide, ester-amide or fatty amine derivative which contains at least one polar group, wherein said ester, amide or ester-amide derivative is derived from an organic acid selected from dialkyl phosphorus acids, dialkyl thiophosphorus acids, and alkylsulfonic acids or (c) an amide derived from a fatty acid and a polyamine, and placing said lubricating oil in the crankcase of an internal combustion engine.

33. The method of claim 32 including adding from about 2.0 to 8.0 percent by weight based on the weight of composition of an ashless dispersant to said oil composition.

34. The method of reducing sludge and wear in an internal combustion engine comprising adding to a lubricating oil composition, based on the total weight of said composition (i) from about 0.05 to 6.0 percent by weight of a cosulfurized blend comprising (a) a carboxylic acid ester material and either (b) an ester, amide, ester-amide or fatty amine derivative which contains at least one polar group, wherein said ester, amide or ester-amide derivative is derived from an organic acid selected from dialkyl phosphorus acids, thiophosphorus acids, and alkylsulfonic acids or (c) an amide derived from a fatty acid and a polyamine, (ii) from about 2.0 to 8.0 percent by weight of an ashless dispersant, (iii) from about 0.5 to 5.0 percent by weight of an overbased alkaline earth metal sulfonate having a total base number of at least 100, and (iv) from about 0.5 to 3.0 percent by weight of a zinc dihydrocarbyl dithiophosphate and (b) placing said lubricating oil composition in the crankcase of an internal combustion engine.

35. A composition comprising a cosulfurized blend of a carboxylic acid ester material and an organic acid ester, amide, or ester-amide derivative which contains at least one polar group and which is selected from the group consisting of:

A. a fatty acid amide of a polyamine of the formula:

$$NH_2(CH_2)_n-(NH(CH_2)_n)_m-NH_2$$

wherein n=2 or 3, and m is 0 to 10;

B. a phosphoramide of an oxy- or thio-alkyl phosphorous acid with an oxyalkylated amine or a polyamine;

C. an ester of an oxy- or thio-alkyl phosphorous acid with an oxyalkylated amine or a polyhydric alcohol;

D. an ester-amide of an oxy- or thioalkyl phosphorous acid with an oxyalkylated amine;

E. a sulfonamide of an alkylsulfonic acid with an oxyalkylated amine or a polyamine;

F. an ester of an alkylsulfonic acid with a polyhydric alcohol.

36. A composition according to claim 35 wherein said derivative is a fatty acid amide of a polyamine of the formula:

$$NH_2(CH_2)_n-(NH(CH_2)_n)_m-NH_2$$

wherein n=2 or 3 and m is 0 to 10.

37. A composition according to claim 35 wherein said derivative is a phosphoramide of an oxy- or thio-alkyl phosphorous acid with an oxyalkylated amine or a polyamine.

38. A composition according to claim 35 wherein said derivative is an ester of an oxy- or thio-alkyl phosphorous acid with an oxyalkylated amine or a polyhydric alcohol.

39. A composition according to claim 35 wherein said derivative is an ester-amide of an oxy- or thioalkyl phosphorous acid with an oxyalkylated amine.

40. A composition according to claim 35 wherein said derivative is a sulfonamide of an alkylsulfonic acid with an oxyalkylated amine or a polyamine.

41. A composition according to claim 35 wherein said derivative is an ester of an alkylsulfonic acid with a polyhydric alcohol.

42. A lubricant composition comprising a major amount of oil of lubricating viscosity and a minor amount of a cosulfurized blend which comprises a carboxylic ester material and a compound of the formula:

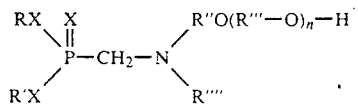

wherein each X is selected from sulfur and oxygen; R and R′ are independently selected from hydrocarbyl radicals containing from about 4 to 20 carbons; R″ and R‴ are divalent aliphatic hydrocarbon radicals containing 1–4 carbon atoms, n is an integer from 0 to 20 and R⁗ is selected from hydrogen and the group —RO(R′-″O)$_n$—H.

43. A composition comprising a cosulfurized blend of a carboxylic acid ester material and a compound of the formula:

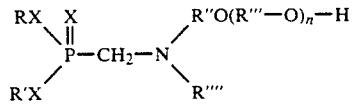

wherein each X is selected from sulfur and oxygen; R and R′ are independently selected from hydrocarbyl radicals containing from about 4 to 20 carbons; R″ and R‴ are divalent aliphatic hydrocarbon radicals containing 1–4 carbon atoms, n is an integer from 0 to 20 and R⁗ is selected from hydrogen and the group —RO(R′-″O)$_n$—H.

* * * * *